US012709315B2

(12) United States Patent
Shen et al.

(10) Patent No.: US 12,709,315 B2
(45) Date of Patent: Aug. 18, 2026

(54) TRAIN OPERATION CONTROL METHOD, VEHICLE ON-BOARD CONTROLLER, AND TRAIN

(71) Applicant: BYD COMPANY LIMITED, Shenzhen (CN)

(72) Inventors: Yakun Shen, Shenzhen (CN); Chujun Chen, Shenzhen (CN); Yang Liao, Shenzhen (CN); Weihua Liu, Shenzhen (CN)

(73) Assignee: BYD Company Limited, Shenzhen (CN)

( * ) Notice: Subject to any disclaimer, the term of this patent is extended or adjusted under 35 U.S.C. 154(b) by 242 days.

(21) Appl. No.: 18/609,689

(22) Filed: Mar. 19, 2024

(65) Prior Publication Data

US 2024/0227888 A1 Jul. 11, 2024

Related U.S. Application Data

(63) Continuation of application No. PCT/CN2022/134368, filed on Nov. 25, 2022.

(30) Foreign Application Priority Data

Nov. 29, 2021 (CN) ..... 202111432946.1

(51) Int. Cl.
*B61L 27/20* (2022.01)
*B61L 23/00* (2006.01)
(Continued)

(52) U.S. Cl.
CPC ..... *B61L 27/20* (2022.01); *B61L 23/005* (2013.01); *B61L 27/04* (2013.01); *B61L 99/002* (2024.01); *B61L 2027/204* (2022.01)

(58) Field of Classification Search
CPC .... B61L 27/20; B61L 27/04; B61L 2027/204; B61L 2027/202; B61L 27/00; B61L 27/70; B61L 23/005; B61L 99/002
See application file for complete search history.

(56) References Cited

U.S. PATENT DOCUMENTS

2023/0322282 A1* 10/2023 Feng ..... B61L 27/04 701/19

FOREIGN PATENT DOCUMENTS

CN 107284471 A 10/2017
CN 110789581 A 2/2020
(Continued)

OTHER PUBLICATIONS

International Search Report and Written Opinion for Application No. PCT/CN2022/134368, mailed on Feb. 24, 2023, 10 pages.

*Primary Examiner* — Jacob M Amick
(74) *Attorney, Agent, or Firm* — Sheppard Mullin Richter & Hampton LLP

(57) ABSTRACT

A method for controlling train operation, includes: receiving an instruction indicating permission to enter a train autonomous circumambulation system (TACS) control level; in response to the train satisfies a condition for entering the TACS control level, controlling the train to enter the TACS control level and transmitting a TACS control notification to a ground device in a route section in which the train is located, the ground device communicating with the train through the TACS control notification based on a TACS control level protocol; and operating the train based on the TACS control level.

18 Claims, 2 Drawing Sheets

(51) Int. Cl.

| | |
|---|---|
| ***B61L 27/04*** | (2006.01) |
| ***B61L 27/70*** | (2022.01) |
| ***B61L 99/00*** | (2006.01) |

(56) References Cited

FOREIGN PATENT DOCUMENTS

| | | | |
|---|---|---|---|
| CN | 112960018 | A | 6/2021 |
| CN | 113320574 | A | 8/2021 |
| CN | 113320575 | A | 8/2021 |
| CN | 113335347 | A | 9/2021 |
| CN | 112678034 | B | 3/2023 |
| EP | 1070649 | A2 | 1/2001 |

* cited by examiner

TRAIN OPERATION CONTROL METHOD, VEHICLE ON-BOARD CONTROLLER, AND TRAIN

CROSS-REFERENCE TO RELATED APPLICATIONS

The application is a continuation application of International Patent Application No. PCT/CN2022/134368 filed on Nov. 25, 2022, which is based on and claims priority to and benefits of Chinese Patent Application No. 202111432946.1, filed on Nov. 29, 2021. The entire content of all of the above-referenced applications is incorporated herein by reference.

FIELD

The present disclosure relates to the field of train operation control technologies, and more particularly, to a train operation control method, a vehicle on-board controller (VOBC), and a train.

BACKGROUND

In the related art, a train of a communication based train control (CBTC) system control level and a train of a train autonomous circumambulation system (TACS) system control level are operated separately. A CBTC system and a TACS system are two systems operating independently.

In the CBTC system, trackside route devices such as a transponder, a signal, a switch, and an axle counter have high control complexity, and require high arrangement costs, and a train tracking interval and operation efficiency are less desirable than those of the TACS system.

In the TACS system, an axle counting device is completely canceled, and only a signal is retained at a switch position, there is no standby operation control level for a downgraded train, and there is no redundant manner for obtaining a position of the train, which cannot simultaneously meet requirements during operation with a normal system and during operation with a downgraded system.

SUMMARY

The present disclosure is to resolve one of technical problems in the related art. A first aspect of the present disclosure to provides a train operation control method, which can realize operation of trains of multiple train autonomous circumambulation system (TACS) control level and multiple communication based train control (CBTC) level on the same route, or realize operation switching of a single train between a CBTC control level and a TACS control level.

A second aspect of the present disclosure provides a vehicle on-board controller (VOBC).

A third aspect of the present disclosure provides a train.

An embodiment of a first aspect of the present disclosure provides a method for controlling train operation. The method includes the following steps: receiving an instruction indicating permission to enter a train autonomous circumambulation system (TACS) control level; in response to the train satisfies a condition for entering the TACS control level, controlling the train to enter the TACS control level and transmitting a TACS control notification to a ground device in a route section in which the train is located, the ground device communicating with the train through the TACS control notification based on a TACS control level protocol; and operating the train based on the TACS control level.

In an embodiment of the present disclosure, the determining whether the train satisfies the condition for entering the TACS control level includes: obtaining a current control level of the train; in response to the current control level of the train is a communication based train control (CBTC) control level, determining that the train satisfies the condition for entering the TACS control level; and in response to the current control level of the train is a point control level or an interlock control level and the train is in communication with the ground device in the route section in which the train is located, determining that the train satisfies the condition for entering the TACS control level.

In an embodiment of the present disclosure, when the train is under the TACS control level, a driving mode of the train comprises an automatic train protection mode (CM), an automatic train driving mode (AM), and an autonomous train operation mode (SAM); when the train is under the CBTC control level, the driving mode comprises the CM and the AM; when the train is under the point control level, the driving mode comprises the CM and the AM; and when the train is under the interlock control level, the driving mode comprises an emergency unrestricted train operating mode (EUM) and a restricted manual mode (RM).

In an embodiment of the present disclosure, after the train is controlled to enter the TACS control level, the method further includes the following steps: if a control level of the train before entering the TACS control level is the CBTC control level or the point control level, controlling the train to maintain a current driving mode; and if the control level of the train before entering the TACS control level is the interlock control level, adjusting the driving mode to the CM or the AM.

In an embodiment of the present disclosure, when the ground device includes a zone controller (ZC), and the ZC communicates with the train based on the TACS control level protocol, the method includes the following steps: receiving train position information within a management range transmitted by the ZC; and transmitting a trackside route resource request to the ZC, and receiving a resource list and a resource control authority from the ZC, the resource list and the resource control authority being established during train operation resource registration performed by the ZC corresponding to the trackside route resource request.

In an embodiment of the present disclosure, before a trackside route resource request is transmitted to the ZC, the method further includes the following step: determining that the driving mode of the train is the SAM.

In an embodiment of the present disclosure, the controlling the train to operate based on the TACS control level includes the following steps: controlling the train to establish a communication connection to an adjacent train; and obtaining a speed profile and a train control instruction of the adjacent train through the communication connection, and adjusting the driving mode of the train to the SAM.

In an embodiment of the present disclosure, the controlling the train to operate based on the TACS control level further includes the following steps: when the driving mode of the train is the SAM, automatically calculating movement authority (MA); calculating a safety protection profile of the train based on the MA, and the speed profile and the train control instruction of the adjacent train; and controlling the train to perform safety protection operation based on the safety protection profile.

In an embodiment of the present disclosure, when the adjacent train is a front train, the calculating the safety protection profile of the train based on the MA, and the speed profile and the train control instruction of the adjacent train, includes the following step: calculating the safety protection profile of the train, based on a manner of being stationary relative to the front train, according to the MA, and the speed profile and the train control instruction of the front train.

According to an embodiment of the present disclosure, the method further includes the following step: when an instruction instructing to exit the TACS control level is received, controlling the train to exit the TACS control level and enter the CBTC control level and adjusting the driving mode of the train from the SAM to the AM.

According to the train operation control method provided in the embodiment of the present disclosure, operation of trains of multiple TACS control level and multiple CBTC level on the same route can be realized, or operation switching of a single train between the CBTC control level and the TACS control level can be realized.

A second aspect of the present disclosure provides a VOBC, which includes a memory, a processor, and a computer program stored in the memory. The computer program, when executed by the processor, implements the train operation control method of the first aspect.

A third aspect of the present disclosure provides a train, which includes the VOBC of the second aspect.

Some of additional aspects and advantages of the present disclosure are provided in the following description, and will be apparent from the following description, or is learned by practice of the present disclosure.

DETAILED DESCRIPTION

Figure 1:
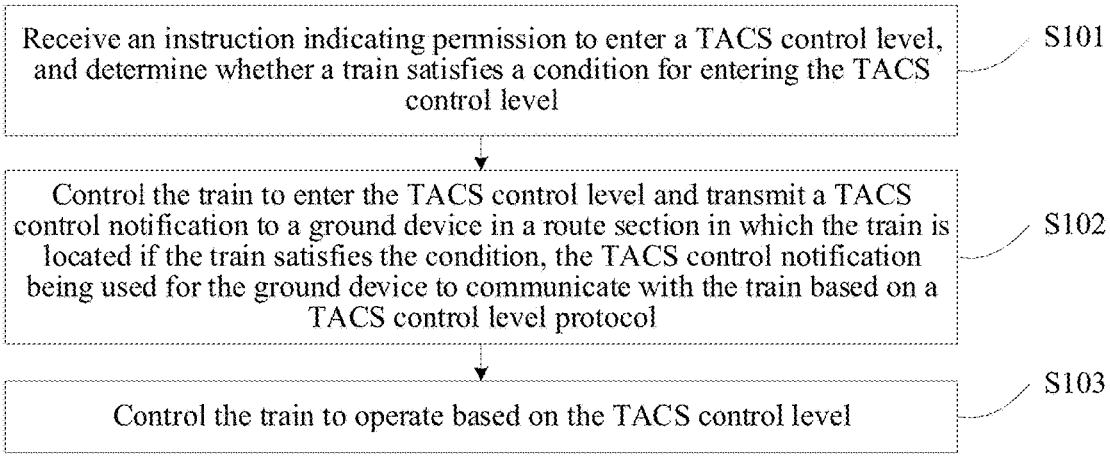
FIG. 1 is a flowchart of a train operation control method according to an embodiment of the present disclosure.

A train operation control method, a vehicle on-board controller (VOBC), and a train in embodiments of the present disclosure are described below with reference to FIG. 1 to FIG. 3. The same or similar elements or the elements having the same or similar functions are denoted by the same or similar reference numerals throughout the description. The embodiments described with reference to the drawings are exemplary, and should not be construed as a limitation on the present disclosure.

In the related art, a communication based train control (CBTC) system is mainly divided into an automatic train monitoring (ATS), a zone controller (ZC), an interlocking system (computer interlocking, CI), a VOBC, a data communication system (DCS), and a maintenance support system (MSS). A train autonomous circumambulation system (TACS) is mainly divided into an ATS, a VOBC, an object controller (OC), a train twins system (TTS), and a DCS. Functions of path planning, movement authority (MA) calculation, and autonomous protection are integrated into the VOBC through vehicle-to-vehicle communication. A ground automatic train protection (ATP) and a CI device are canceled. The OC is configured to control a trackside device.

The present disclosure is applicable to a route with mixed operation of the TACS system and the CBTC system or an intermediate state route transitioning from the CBTC system to the TACS system. A route should be equipped with conditions for operation in a CBTC downgrade mode and a TACS downgrade mode, for example, the route is equipped with an axle counting device for redundantly detecting a train position, or a trackside radio frequency identification (RFID) reader and a corresponding on-board tag on the trains. In this way, an approximate position of a downgraded train can be redundantly obtained to implement the downgraded operation. At the TACS control level, reliance on a speed sensor can be reduced. Accurate positioning with clear environmental characteristics is provided according to radar and vision technologies, which is used as a supplementary correction for speed sensor positioning, to realize combined positioning, thereby realizing safer on-board autonomous computing of movement authority (MA) rather than using an MA of the ground ATP. Generally, operation of the TACS system and the CBTC system on the same route or operation switching between the CBTC system and the TACS system is realized.

Conventional train operation control levels include an interlock control level, a point control level, and a CBTC control level. In the present disclosure, a TACS control level higher than the CBTC control level is added. The operation at these levels are as follows.

The interlock control level is a downgraded control mode of the CBTC system, which is based on a fixed block principle. A driver drives a train based on display of a trackside signal. The point train control level is a downgraded control mode of the CBTC system, which is based on the fixed block principle and adopts the primary-mode speed-profile-based control to supervise the train operation in real time. The CBTC control level is a downgraded control mode of the CBTC system, which is based on a moving block principle and adopts the continuous speed-profile-based control to supervise the train operation in real time. In the present disclosure, the TACS control level is a control mode higher than the CBTC system, which realizes a vehicle-to-vehicle communication. A rear train can calculate a manner of controlling of an MA destination based on a relative speed of the front train, to supervise the train operation in real time.

FIG. 1 is a flowchart of a train operation control method according to an embodiment of the present disclosure. As shown in FIG. 1, the train operation control method includes the following steps.

S101: An instruction indicating permission to enter a TACS control level is received, and it is determined whether a train satisfies a condition for entering the TACS control level.

Figure 2:
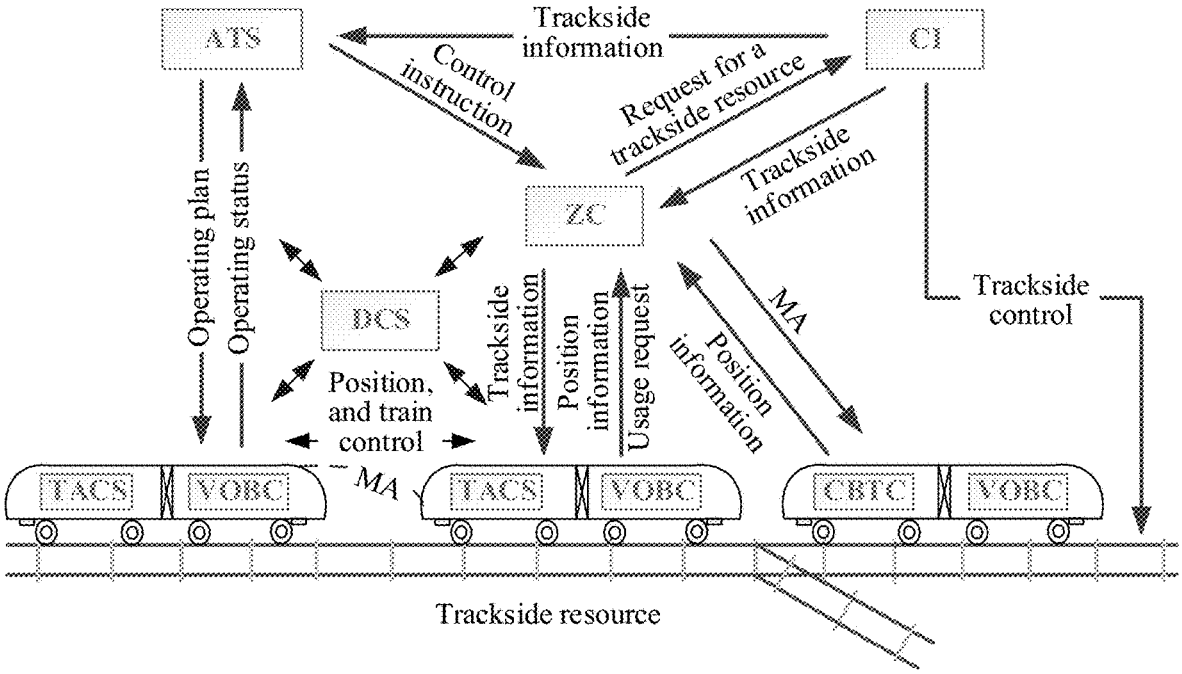
FIG. 2 is a schematic structural diagram in which a ground device communicates with a train based on a train autonomous circumambulation system (TACS) control level protocol according to an embodiment of the present disclosure.
Figure 3:
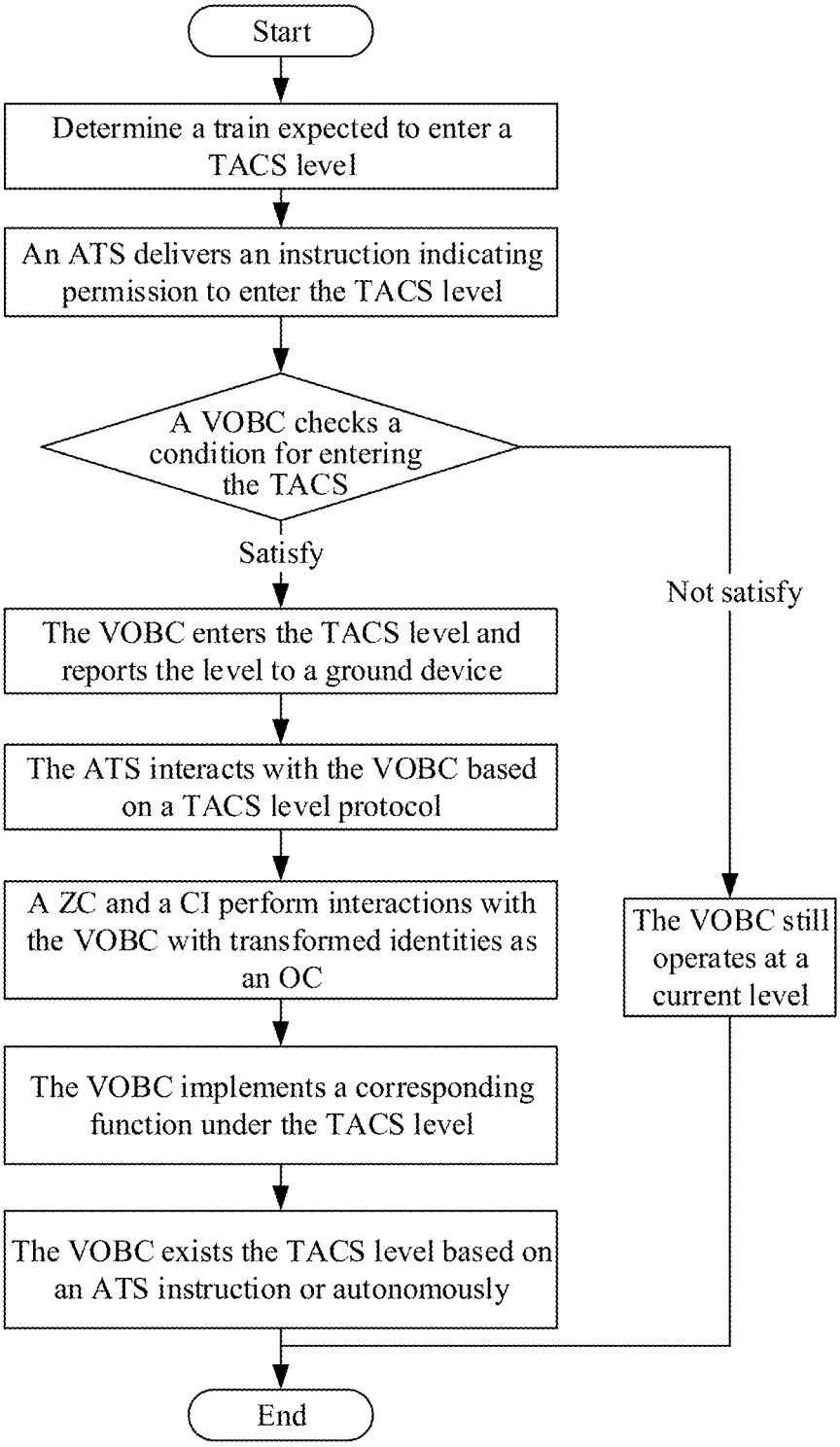
FIG. 3 is a flowchart of a train operation control method according to a specific embodiment of the present disclosure.

In an embodiment, referring to FIG. 2 and FIG. 3, a VOBC determines whether the train satisfies the condition for entering the TACS control level after receiving the instruction indicating permission to enter the TACS control level from an ATS.

It should be noted that, if the train is expected to operate under the TACS control level to realize a more efficient operation, the train needs to be upgraded from a level to the TACS control level. To upgrade the train from a level to the TACS control level, the trains expected to enter the TACS control level need to be determined first. These trains may be trains that are about to enter the TACS control level and that operate mixed with other non-TACS control level trains. A dispatcher may deliver, through the ATS, an instruction indicating permission to enter the TACS control level to a train permitted to enter the TACS control level. To realize the autonomous MA calculation by the VOBC during the TACS control level operation, a train entering the TACS control level needs to be accurately positioned by radar detection and vision technologies. In this way, the VOBC can achieve a sufficient safety protection under the TACS control level.

Further, that it is determined whether a train satisfies a condition for entering the TACS control level may include the following steps. A current control level of the train is obtained. It is determined that the train satisfies the condition for entering the TACS control level if the current control level of the train is a CBTC control level. It is determined that the train satisfies the condition for entering the TACS control level if the current control level of the train is a point control level or an interlock control level and the train normally communicates with the ground device in the route section in which the train is located.

In an embodiment, referring to FIG. 2 and FIG. 3, the VOBC needs to periodically report a train control level and a train driving mode of the VOBC to the ground device such as an ATS, a ZC, and a CI. If the VOBC determines that the current control level of the VOBC is the CBTC control level, the VOBC modifies the control level to the TACS control level, and the train driving mode is not changed, which is still an original driving mode. If the VOBC determines that the current control level is a level lower than the CBTC control level, (such as the point control level or the interlock control level), and the VOBC communicates with the ground device normally, (such as communicates with the ZC and the ATS), the VOBC modifies the control level to the TACS control level. Otherwise, the current control level is maintained. It should be noted that, train-to-train communication, train-to-ZC communication, and train-to-ATS communication can be realized through the DCS.

A correspondence between the control level and the driving mode is shown in Table 1. The driving modes under the TACS control level include an automatic train protection mode (coded mode, CM), an automatic train driving mode (auto mode, AM), and an autonomous train operation mode (super autonomous mode, SAM). The driving modes under the CBTC control level include the CM and the AM. Driving modes under the point control level include the CM and the AM. The driving modes under the interlock control level include an unrestricted manned driving mode (emergency unrestricted train operating mode, EUM) and a restricted manned driving mode (restricted manual mode, RM).

TABLE 1

| | EUM | RM | CM | AM | SAM |
|---|---|---|---|---|---|
| TACS control level | x | x | ○ | ○ | ○ |
| CBTC control level | x | x | ○ | ○ | x |
| Point control level | x | x | ○ | ○ | x |
| Interlock control level | ○ | ○ | x | x | x |

Note:
x/○ indicates that the driving mode is enabled/disabled under a control level.

S102: The train is controlled to enter the TACS control level and a TACS control notification is transmitted to a ground device in a route section in which the train is located if the train satisfies the condition, the TACS control notification being used for the ground device to communicate with the train based on a TACS control level protocol.

In an embodiment, referring to FIG. 3, if the condition for entering the TACS control level is satisfied, the train may be controlled to upgrade the current control level to the TACS control level, and the TACS control notification is transmitted to the ground device in the route section in which the train is located. Otherwise, the train may not enter the TACS control level, and the train still operates at the current control level. In addition, after the control level of the VOBC is changed to the TACS control level, the VOBC needs to report the operation control level being the TACS control level to the ground device (such as the ZC, the CI, and the ATS). In this case, the ATS determines that the operation level of the VOBC is the TACS control level, and then communicates with the VOBC and outputs instruction based on the TACS control level protocol. When the ATS determines that the operation level of the VOBC is not TACS control level, the ATS still communicates with the VOBC based on the CBTC control level protocol.

It should be noted that, before the VOBC enters the TACS control level, when the control level of the VOBC is a lower level, the protocol information communicated between the ATS and the VOBC should not include content relevant to the TACS control level, such as a dispatching plan, a train rescue instruction and response, or a virtual coupling instruction and response delivered by the ATS to the VOBC.

In an embodiment, the ground device includes a ZC. The ground device communicates with the train based on the TACS control level protocol. The train operation control method may include the following steps. Train position information within a management range transmitted by the ZC is received. A trackside route resource request is transmitted to the ZC, and a resource list and a resource control authority established by the ZC are received, the resource list and the resource control authority being established during the train operation resource registration performed by the ZC for the trackside route resource request.

In this embodiment of the present disclosure, if the ZC determines that the operation level of the VOBC is the TACS control level, the ZC communicates with a train at the TACS control level based on a communication protocol between the OC and the VOBC. The position information of all trains within the management range of the OC is transmitted to the VOBC, and trackside route resources within the management range of the OC are transmitted to the VOBC, and a control instruction of the VOBC for the trackside route resources is received to realize the utilization and control of the trackside route resources.

In an embodiment, referring to FIG. 2, the position information of the trains within the management range of the ZC is transmitted to the train at the TACS control level, and the train at the TACS control level realizes subsequent functional processing based on the position information of the trains transmitted by the ZC. When the train at the TACS control level needs to use the trackside route resources, the train transmits a trackside route resource request to the ZC. The ZC performs the train operation resource registration for the trackside route resource request and establishes a resource list for resource control authority management, and then transmits the train operation resource list and the resource control authority to the train that transmits the request. The ZC may check and perform coordinated management on the conflict between a resource control authority of a TACS control level VOBC and a trackside control instruction of a CBTC control level CI. The trackside control instruction of the CI has a highest priority, and the resource control authority of the VOBC is has a lowest priority. Finally, the resource request instruction of the VOBC is forwarded to the CI to realize a non-conflict control and utilization of the trackside route resources.

It should be noted that, before the trackside route resource request is transmitted to the ZC, the train operation control method may further include the following step. It is determined that the driving mode of the train is the SAM. In other words, only the train in the SAM mode can realize control for the trackside route resource request. When the VOBC determines that the current driving mode is not the SAM, the control instruction for the trackside route resources may not be generated.

Therefore, referring to FIG. 3, the ZC can simultaneously realize an ATP function for a train at the CBTC control level and a management function for an OC at a TACS control level, to adapt to a scenario of mixed operation of different trains on the route at the CBTC control level or the TACS control level. Switching between the two functions is controlled through the operation control level of the VOBC. If the operation level of the VOBC is the TACS control level, a function of OC realized by the ZC is enabled, and if the operation level of the VOBC is not the TACS control level, the function of the OC realized by the ZC is disabled. The original CBTC functions of the ZC are normally implemented when the VOBC is at any control level, and the train operation may be performed without following the safety protection of the ZC when the VOBC is at the TACS control level.

In an embodiment of the present disclosure, after the train is controlled to enter the TACS control level, the train operation control method may further include the following steps. The train is controlled to maintain a current driving mode if a control level of the train before entering the TACS control level is the CBTC control level or the point control level. A driving mode of the train is controlled to adjust to the CM or the AM if the control level of the train before entering the TACS control level is the interlock control level.

S103: The train is controlled to operate based on the TACS control level.

In an example, controlling the train based on the TACS control level may include the following steps. The train is controlled to establish a communication connection to an adjacent train. A speed profile and a train control instruction of the adjacent train are obtained through the communication connection, and the driving mode of the train is adjusted to the SAM.

In an embodiment, referring to FIG. 3, in the TACS control level, the VOBC can operate in accordance with the safety protection of the TACS control level, to realize the functions of adjacent train identification, vehicle-to-vehicle communication, autonomous computing MA, route selection and planning, and conflict inspection and processing. Referring to FIG. 2, after the VOBC successfully communicates with the adjacent train (such as the front train), the VOBC obtains the position information as well as ATP and automatic train operation (ATO) speed profiles and train control instructions of the adjacent train through the vehicle-to-vehicle communication. After successfully communicating with the adjacent train, the VOBC may further modify the train driving mode to the SAM, and notify the ground device that the train driving mode has been changed.

In another example, controlling the train based on the TACS control level may further include the following steps. The MA is automatically calculated when the driving mode of the train is the SAM. A safety protection profile of the train is calculated based on the MA and the speed profile and the train control instruction of the adjacent train. The train is controlled to perform a safety protection operation based on the safety protection profile. When the adjacent train being a front train, the calculation of the safety protection profile of the train includes the following step. The safety protection profile of the train is calculated based on a manner of being stationary relative to the front train, the MA that is automatically calculated, and the speed profile and the train control instruction of the front train.

In an embodiment, referring to FIG. 2, if the VOBC determines that the current driving mode is the SAM, the VOBC can automatically calculate the MA. For a higher operating efficiency, the safety protection profile of the current train may be calculated based on a relative speed of 0 with respect to the front train, because the train control instruction and the speed profile of the front train are known. In this way, safety and a reduced tracking interval can be realized. In addition, if the VOBC determines that the current driving mode is not the SAM, the safety protection operation is still performed by using the MA calculated by the ZC.

In an embodiment of the present disclosure, the train operation control method may further include the following step. The train is controlled to exit the TACS control level and enter the CBTC control level, and the driving mode of the train is adjusted from the SAM to the AM when an instruction instructing to exit the TACS control level is received.

In an embodiment, referring to FIG. 3, a train operating under the TACS control level can transmit an instruction instructing to exit the TACS control level to the VOBC through the ATS. In an embodiment, the VOBC may automatically exit the TACS control level and switch to the CBTC control level. The VOBC may implement the following steps to automatically exit the TACS control level and switch to the CBTC control level.

S1: The VOBC determines that communication between the ZC and the ATS is normal.

S2: The VOBC downgrades the driving mode from the SAM mode to the AM mode, starts the safety protection operation by using the MA of the ZC, and quits a control authority on the trackside route resources.

S3: The VOBC downgrades the operation control level to the CBTC control level after determining that the VOBC stops the control on the trackside route resources, and notifies the ground device that the control level is reduced to the CBTC control level.

It should be noted that, when the communication between the VOBC and the front train is interrupted, the VOBC may automatically switch to the CBTC control level based on the foregoing steps.

Based on the above, according to the train operation control method, by operating the train qualified for upgrading under the TACS control level, and operating the train not upgraded under the CBTC control level, the mixed operation of the TACS control level and the CBTC control level may be achieved. The trains perform the safety protection operation according to the respective MA sources without interfering with each other. Not only the original functions of the CBTC are retained, but also new functions of the TACS are added.

The present disclosure further provides a VOBC, which includes a memory, a processor, and a computer program stored in the memory. The computer program, when executed by the processor, implements the foregoing train operation control method.

According to the VOBC provided in this embodiment of the present disclosure, when the computer program corresponding to the foregoing train operation control method stored in the memory thereof is executed by the processor, the operations of multiple trains of the TACS control level and multiple trains of the CBTC level on the same route can be realized, or switching the operation of a single train between the CBTC control level and the TACS control level can be realized.

The present disclosure further provides a vehicle, which includes the foregoing VOBC.

According to the train provided in this embodiment of the present disclosure, through the foregoing VOBC, the operations of multiple trains of the TACS control level and multiple trains of the CBTC level on a same route can be realized, or switching the operation of a single train between the CBTC control level and the TACS control level can be realized.

It should be noted that, the logic and/or steps shown in the flowchart or described in other manners herein may be regarded as a list of executable instructions for implementing logical functions, which may be implemented in any computer-readable medium for use by or in combination with an instruction execution system, a device, or an apparatus (such as a computer-based system, a system including a processor, or other systems that can fetch from an instruction execution system, a device, or an apparatus and execute the instructions). In the specification of this application, the "computer-readable medium" may be any device that can include, store, communicate, propagate, or transmit a program for use by or in combination with an instruction execution system, a device, or an apparatus. Examples (a non-exhaustive list) of the computer-readable storage medium include an electrical connection portion (an electronic device) with one or more wires, a portable computer case (a magnetic device), a random access memory (RAM), a read-only memory (ROM), an erasable programmable read-only memory (EPROM or a flash memory), an optical fiber device, and a portable compact disk read-only memory (CDROM). In addition, the computer-readable medium even may be paper or other suitable media on which the program can be printed, because the program can be obtained electronically, for example, by optically scanning the paper or the other media, then performing editing, interpreting, or processing in other suitable manners if necessary, and then stored in a computer memory.

It should be understood that, parts of the present disclosure may be implemented by using hardware, software, firmware, or a combination thereof. In the foregoing implementations, a plurality of steps or methods may be implemented by using software or firmware stored in a memory and executable by a proper instruction execution system. If hardware is used for implementation, same as another implementation, implementation may be performed by using any of the following technologies well known in the art or a combination thereof: a discrete logic circuit including a logic gate circuit for implementing a logic function of a data signal, a dedicated integrated circuit including a proper combinational logic gate circuit, a programmable gate array (PGA), a field programmable gate array (FPGA), and the like.

In the description of the present disclosure, description of a reference term such as "an embodiment", "some embodiments", "an example", "a specific example", or "some examples" means that specific features, structures, materials, or characteristics described with reference to the embodiment or the example is included in at least one embodiment or example of the present disclosure. In this specification, schematic descriptions of the foregoing terms do not necessarily refer to the same embodiment or example. In addition, the described specific features, structures, materials, or characteristics may be combined in a proper manner in any one or more embodiments or examples.

In the descriptions of this specification, orientation or position relationships indicated by the terms such as "center", "longitudinal", "transverse", "length", "width", "thickness", "up", "down", "front", "back", "left", "right", "vertical", "horizontal", "top", "bottom", "inside", "outside", "clockwise", "anticlockwise", "axial direction", "radial direction", and "circumferential direction" are based on orientation or position relationships shown in the drawings, rather than indicating or implying that the mentioned device or element needs to have a particular orientation or be constructed and operated in a particular orientation. Therefore, such terms should not be construed as a limitation on the present disclosure.

In addition, the terms "first" and "second" are merely used for description, and shall not be construed as indicating or implying relative importance or implying a quantity of indicated technical features. Therefore, the features defined with "first" and "second" may explicitly or implicitly include at least one of the features. In the description of this application, "a plurality of" means at least two, such as two or three, unless otherwise definitely and specifically defined.

In the descriptions of this specification, unless otherwise stated, terms "mount", "connect", "connection", and "fix" should be understood in a broad sense. For example, the connection may be a fixed connection, a detachable connection, or an integral connection; or the connection may be a mechanical connection or an electrical connection; or may be a direct connection, an indirect connection through an intermediate medium, internal communication between two elements, or an interaction relationship between two elements. A person of ordinary skill in the art can understand specific meanings of the terms in the present disclosure based on specific situations.

In the present disclosure, unless otherwise explicitly specified and defined, a first feature being "on" or "under" a second feature may indicate that the first feature is in direct contact with the second feature, or the first feature is in indirect contact with the second feature by using an intermediate medium. In addition, the first feature being "above", "over", or "on" the second feature may mean that the first feature is directly above or obliquely above the second feature, or may merely mean that the first feature is at a higher horizontal position than the second feature. The first feature being "below", "under", and "beneath" the second feature may mean that the first feature is directly below or obliquely below the second feature, or merely mean that the first feature is at a lower horizontal position than the second feature.

Although the embodiments of the present disclosure have been shown and described above, it may be understood that, the above embodiments are exemplary and should not be understood as a limitation on the present disclosure. A person of ordinary skill in the art may make changes, modifications, replacements, or variations to the above embodiments within the scope of the present disclosure.

What is claimed is:

1. A method for controlling train operation of a train, comprising:

receiving an instruction indicating permission to enter a train autonomous circumambulation system (TACS) control level;

determining whether the train satisfies a condition for entering the TACS control level;

in response to that the train satisfies the condition for entering the TACS control level, controlling the train to enter the TACS control level and transmitting a TACS control notification to a ground device in a route section in which the train is located, the ground device communicating with the train through the TACS control notification based on a TACS control level protocol; and operating the train based on the TACS control level, wherein when the train is under the TACS control level, a driving mode of the train comprises an automatic train protection mode (CM), an automatic train driving mode (AM), and an autonomous train operation mode (SAM);

when the train is under a communication based train control (CBTC) control level, the driving mode comprises the CM and the AM;

when the train is under a point control level, the driving mode comprises the CM and the AM; and when the train is under an interlock control level, the driving mode comprises an emergency unrestricted train operating mode (EUM) and a restricted manual mode (RM).

2. The method according to claim 1, wherein determining whether the train satisfies the condition for entering the TACS control level comprises:

obtaining a current control level of the train;

in response to that the current control level of the train is the CBTC control level, determining that the train satisfies the condition for entering the TACS control level; and in response to that the current control level of the train is the point control level or the interlock control level and the train is in communication with the ground device in the route section in which the train is located, determining that the train satisfies the condition for entering the TACS control level.

3. The method according to claim 1, after controlling the train to enter the TACS control level, further comprising:

if a control level of the train before entering the TACS control level is the CBTC control level or the point control level, controlling the train to maintain a current driving mode; and if the control level of the train before entering the TACS control level is the interlock control level, adjusting the driving mode to the CM or the AM.

4. The method according to claim 1, wherein the ground device comprises a zone controller (ZC); the ZC communicates with the train based on the TACS control level protocol; and the method comprises:

receiving train position information within a management range transmitted by the ZC; and transmitting a trackside route resource request to the ZC, and receiving a resource list and a resource control authority from the ZC, the resource list and the resource control authority being established during train operation resource registration performed by the ZC corresponding to the trackside route resource request.

5. The method according to claim 4, before transmitting the trackside route resource request to the ZC, further comprising:

determining that the driving mode of the train is the SAM.

6. The method according to claim 1, wherein controlling the train to operate based on the TACS control level comprises:

controlling the train to establish a communication connection to an adjacent train; and obtaining a speed profile and a train control instruction of the adjacent train through the communication connection, and adjusting the driving mode of the train to the SAM.

7. The method according to claim 6, wherein controlling the train to operate based on the TACS control level further comprises:

when the driving mode of the train is the SAM, automatically calculating a movement authority (MA);

calculating a safety protection profile of the train based on the MA, and the speed profile and the train control instruction of the adjacent train; and controlling the train to perform safety protection operation based on the safety protection profile.

8. The method according to claim 7, wherein when the adjacent train is a front train, calculating the safety protection profile of the train based on the MA, and the speed profile and the train control instruction of the adjacent train, comprises:

calculating the safety protection profile of the train, based on a manner of being stationary relative to the front train, according to the MA, and the speed profile and the train control instruction of the front train.

9. The method according to claim 1, when an instruction instructing to exit the TACS control level is received, further comprising:

controlling the train to exit the TACS control level and enter the CBTC control level, and adjusting the driving mode of the train from the SAM to the AM.

10. A vehicle on-board controller (VOBC), comprising a memory, a processor, and a computer program stored in the memory, wherein the processor is configured to execute the computer program to perform operations comprising:

receiving an instruction indicating permission to enter a train autonomous circumambulation system (TACS) control level of a train;

determining whether the train satisfies a condition for entering the TACS control level;

in response to that the train satisfies the condition for entering the TACS control level, controlling the train to enter the TACS control level and transmitting a TACS control notification to a ground device in a route section in which the train is located, the ground device communicating with the train through the TACS control notification based on a TACS control level protocol; and operating the train based on the TACS control level, wherein when the train is under the TACS control level, a driving mode of the train comprises an automatic train protection mode (CM), an automatic train driving mode (AM), and an autonomous train operation mode (SAM);

when the train is under a communication based train control (CBTC) control level, the driving mode comprises the CM and the AM;

when the train is under a point control level, the driving mode comprises the CM and the AM; and when the train is under an interlock control level, the driving mode comprises an emergency unrestricted train operating mode (EUM) and a restricted manual mode (RM).

11. The VOBC according to claim 10, wherein determining whether the train satisfies the condition for entering the TACS control level comprises:

obtaining a current control level of the train;

in response to that the current control level of the train is the CBTC control level, determining that the train satisfies the condition for entering the TACS control level; and in response to that the current control level of the train is the point control level or the interlock control level and the train is in communication with the ground device in the route section in which the train is located, determining that the train satisfies the condition for entering the TACS control level.

12. The VOBC according to claim 10, after controlling the train to enter the TACS control level, wherein the operations further comprise:

if a control level of the train before entering the TACS control level is the CBTC control level or the point control level, controlling the train to maintain a current driving mode; and if the control level of the train before entering the TACS control level is the interlock control level, adjusting the driving mode to the CM or the AM.

13. The VOBC according to claim 10, wherein the ground device comprises a zone controller (ZC); the ZC communicates with the train based on the TACS control level protocol; and the operations further comprise:

receiving train position information within a management range transmitted by the ZC; and transmitting a trackside route resource request to the ZC, and receiving a resource list and a resource control authority from the ZC, the resource list and the resource control authority being established during train operation resource registration performed by the ZC corresponding to the trackside route resource request.

14. The VOBC according to claim 13, wherein before transmitting the trackside route resource request to the ZC, the operations further comprise:

determining that the driving mode of the train is the SAM.

15. The VOBC according to claim 10, wherein controlling the train to operate based on the TACS control level comprises:

controlling the train to establish a communication connection to an adjacent train; and obtaining a speed profile and a train control instruction of the adjacent train through the communication connection, and adjusting the driving mode of the train to the SAM.

16. The VOBC according to claim 15, wherein controlling the train to operate based on the TACS control level further comprises:

when the driving mode of the train is the SAM, automatically calculating a movement authority (MA);

calculating a safety protection profile of the train based on the MA, and the speed profile and the train control instruction of the adjacent train; and controlling the train to perform safety protection operation based on the safety protection profile.

17. The VOBC according to claim 16, wherein when the adjacent train is a front train, calculating the safety protection profile of the train based on the MA, and the speed profile and the train control instruction of the adjacent train, comprises:

calculating the safety protection profile of the train, based on a manner of being stationary relative to the front train, according to the MA, and the speed profile and the train control instruction of the front train.

18. A train, comprising a vehicle on-board controller (VOBC), the VOBC comprising a memory, a processor, and a computer program stored in the memory, wherein the processor is configured to execute the computer program to perform operations comprising:

receiving an instruction indicating permission to enter a train autonomous circumambulation system (TACS) control level;

determining whether the train satisfies a condition for entering the TACS control level;

in response to that the train satisfies the condition for entering the TACS control level, controlling the train to enter the TACS control level and transmitting a TACS control notification to a ground device in a route section in which the train is located, the ground device communicating with the train through the TACS control notification based on a TACS control level protocol; and operating the train based on the TACS control level, wherein when the train is under the TACS control level, a driving mode of the train comprises an automatic train protection mode (CM), an automatic train driving mode (AM), and an autonomous train operation mode (SAM);

when the train is under a communication based train control (CBTC) control level, the driving mode comprises the CM and the AM;

when the train is under a point control level, the driving mode comprises the CM and the AM; and when the train is under an interlock control level, the driving mode comprises an emergency unrestricted train operating mode (EUM) and a restricted manual mode (RM).

* * * * *